US010903597B2

(12) United States Patent
Shimizu

(10) Patent No.: US 10,903,597 B2
(45) Date of Patent: Jan. 26, 2021

(54) CONNECTOR

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventor: Toru Shimizu, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/638,343

(22) PCT Filed: Sep. 13, 2018

(86) PCT No.: PCT/JP2018/033985
§ 371 (c)(1),
(2) Date: Feb. 11, 2020

(87) PCT Pub. No.: WO2019/065275
PCT Pub. Date: Apr. 4, 2019

(65) Prior Publication Data

US 2020/0227852 A1 Jul. 16, 2020

(30) Foreign Application Priority Data

Sep. 28, 2017 (JP) ..... 2017-188445

(51) Int. Cl.
*H01R 13/15* (2006.01)
*H01R 13/10* (2006.01)
(Continued)

(52) U.S. Cl.
CPC ..... *H01R 13/15* (2013.01); *H01R 13/05* (2013.01); *H01R 13/10* (2013.01); *H01R 13/11* (2013.01)

(58) Field of Classification Search
CPC ..... H01R 13/05; H01R 13/10; H01R 13/11; H01R 13/14; H01R 13/15; H01R 13/17;
(Continued)

(56) References Cited

U.S. PATENT DOCUMENTS 3,848,223 A * 11/1974 Pechard ..... H01R 12/721 439/637
4,119,357 A * 10/1978 Bonhomme ..... H01R 12/88 439/260
(Continued)

FOREIGN PATENT DOCUMENTS

EP 2 337 156 A1 6/2011
JP S43-030388 B1 12/1968
(Continued)

OTHER PUBLICATIONS

Dec. 4, 2018 Search Report issued in International Patent Application No. PCT/JP2018/033985.

*Primary Examiner* — Edwin A. Leon
*Assistant Examiner* — Matthew T Dzierzynski
(74) *Attorney, Agent, or Firm* — Oliff PLC

(57) ABSTRACT

A connector includes a connector housing, a female terminal, and a contact. The connector housing includes a contact holder that holds the contact such that the contact can roll in a direction toward a terminal insertion surface and a direction away from the terminal insertion surface. The contact holder includes a restriction wall that restricts movement of the contact, and holds a compression coil spring. Provided that an initial length of the compression coil spring is a length in a state of biasing the contact so as to abut against the restriction wall, a difference between the initial length of
(Continued)

the compression coil spring and a close-contact length thereof is larger than half a movement distance from an insertion start position at which a male terminal abuts against the contact abutting against the restriction wall to a position at which insertion of the male terminal is completed.

7 Claims, 18 Drawing Sheets

(51) Int. Cl.
*H01R 13/05* (2006.01)
*H01R 13/11* (2006.01)

(58) Field of Classification Search
CPC ..... H01R 13/18; H01R 13/187; H01R 13/26; H01R 4/48; H01R 4/4863; H01R 4/4872; H01R 4/489
USPC ..... 439/839, 840, 841
See application file for complete search history.

(56) References Cited

U.S. PATENT DOCUMENTS

| | | | | |
|---|---|---|---|---|
| 4,911,644 | A * | 3/1990 | Bond | H01R 12/62 439/493 |
| 5,990,697 | A * | 11/1999 | Kazama | G01R 1/067 324/72.5 |
| 6,857,908 | B2 * | 2/2005 | Burmeister | H01R 12/79 439/632 |
| 7,972,179 | B2 * | 7/2011 | Inoue | H01R 13/113 439/637 |
| 10,644,468 | B2 * | 5/2020 | White | H01R 13/02 |
| 2003/0232533 | A1 | 12/2003 | Burmeister | |
| 2005/0064733 | A1 * | 3/2005 | Korsunsky | H01R 13/193 439/61 |
| 2008/0214053 | A1 * | 9/2008 | Hohne | H01H 1/50 439/626 |
| 2020/0194925 | A1 * | 6/2020 | Shinyama | H01R 13/6315 |

FOREIGN PATENT DOCUMENTS

| | | | |
|---|---|---|---|
| JP | H04-014779 | A | 1/1992 |
| JP | H11-162588 | A | 6/1999 |
| JP | 2004-022547 | A | 1/2004 |

* cited by examiner

CONNECTOR

TECHNICAL FIELD

The technology disclosed in the present specification relates to a connector.

BACKGROUND ART

A terminal fitting is known that is included in a connector and in which metal balls are used as contact portions to be connected to a partner conductive member (see Patent Document 1). This terminal fitting includes a pair of elastic contact pieces that are arranged so as to face each other and that include leading end portions that are folded back inward. The folded portions of the elastic contact pieces have elongated holes that extend in an insertion direction of the partner conductive member, and the metal balls are arranged inside the elongated holes. When the partner conductive member is inserted between the pair of elastic contact pieces, the pair of elastic contact pieces bend outward away from each other, and each metal ball is sandwiched between the elastic contact piece and the partner conductive member under an elastic restoring force. Thus, the terminal fitting and the partner conductive member are electrically connected to each other.

When the partner conductive member is inserted, the metal balls roll along the elongated holes following the movement of the partner conductive member, and therefore insertion resistance can be reduced and sliding friction at contact portions between the terminal fitting and the partner conductive member can be reduced.

SUMMARY

In the above-described configuration, if the metal balls reach innermost ends of the elongated holes during the insertion operation, the metal balls cannot roll further, and the insertion resistance reducing effect and the sliding friction reducing effect can no longer be achieved.

A connector disclosed in the present specification includes a connector housing that includes a terminal housing chamber that is open in one surface and is capable of housing a partner terminal, a terminal fitting that is housed in the terminal housing chamber and is electrically connectable to the partner terminal, and a contact that is housed in the terminal housing chamber and is in contact with the terminal fitting. The connector housing includes a contact holding portion that holds the contact such that the contact can roll in a direction toward the one surface and in a direction away from the one surface. In the contact holding portion, a restriction wall that abuts against the contact and restricts movement of the contact in the direction toward the one surface is arranged in one end portion that is closer to the one surface, out of opposite end portions of a movement path of the contact. A compression coil spring that biases the contact toward the restriction wall is held in the contact holding portion. Provided that an initial length of the compression coil spring is a length in a state of biasing the contact so as to abut against the restriction wall, a difference between the initial length of the compression coil spring and a close-contact length thereof is larger than half a movement distance from an insertion start position at which the partner terminal abuts against the contact abutting against the restriction wall to an insertion completion position at which insertion of the partner terminal into the connector housing is completed.

With this configuration, the contact can be prevented from becoming unable to roll during an insertion operation of the partner terminal, and the insertion resistance reducing effect and the sliding friction reducing effect can be continuously achieved from an initial stage to a final stage of the insertion operation of the partner terminal.

In the above-described configuration, the terminal fitting may include a base portion and a plurality of contact pieces that extend from the base portion, the number of contacts that are held in the connector housing may be the same as the number of the plurality of contact pieces, and the contacts may be in contact with the contact pieces in one-to-one correspondence.

With this configuration, the plurality of contact pieces can undergo flexure deformation independently of each other, and accordingly, even if there is a difference between the size of the plurality of contacts due to manufacturing tolerance, all of the contacts can be reliably brought into contact with the terminal fitting.

In the above-described configuration, the contact pieces may be plate spring portions that bias the contacts toward the partner terminal.

With this configuration, the terminal fitting, the contacts, and the partner terminal can be brought into contact with each other under a constant contact pressure using the biasing force of the contact pieces, and electrical connection between the terminal fitting and the partner terminal can be reliably realized. Furthermore, the terminal fitting itself has the function of a spring, and accordingly there is no need to separately provide a member for biasing the contacts toward the partner terminal, and the configuration of the connector can be simplified In the above-describe configuration, the connector may include a biasing member that is housed in the terminal housing chamber and biases the terminal fitting toward the contact. Also, the biasing member may be a diagonally wound coil spring that has a coil shape that is formed by winding a wire a plurality of turns so as to incline in one direction relative to an axis.

With this configuration, the terminal fitting, the contact, and the partner terminal can be brought into contact with each other under a constant contact pressure using the biasing force of the biasing member, and electrical connection between the terminal fitting and the partner terminal can be reliably realized.

In the above-described configuration, the connector may include a cushioning member that is arranged within the terminal housing chamber and is interposed between the connector housing and the terminal fitting, the partner terminal, or the biasing member.

With this configuration, the cushioning member takes on stress from the terminal fitting, the partner terminal, or the biasing member, which derives from a spring action of the contact pieces or the biasing member, and therefore creep deformation of the connector housing can be suppressed.

In the above-described configuration, the terminal fitting may include a groove that extends along the movement path of the contact.

Advantageous Effects of Invention

With the connector disclosed in the present specification, the insertion resistance reducing effect and the sliding friction reducing effect can be continuously achieved from an initial stage to a final stage of an insertion operation.

DESCRIPTION OF EMBODIMENTS

Embodiment 1

Embodiment 1 will be described with reference to FIGS. 1 to 10. A connector 1 according to the present embodiment includes a connector housing 10 that is made of a synthetic resin, and a female terminal Tf1 (corresponding to a terminal fitting), a diagonally wound coil spring 30 (corresponding to a biasing member), three contacts C, and three compression coil springs Sc that are held in the connector housing 10.

Figure 2:
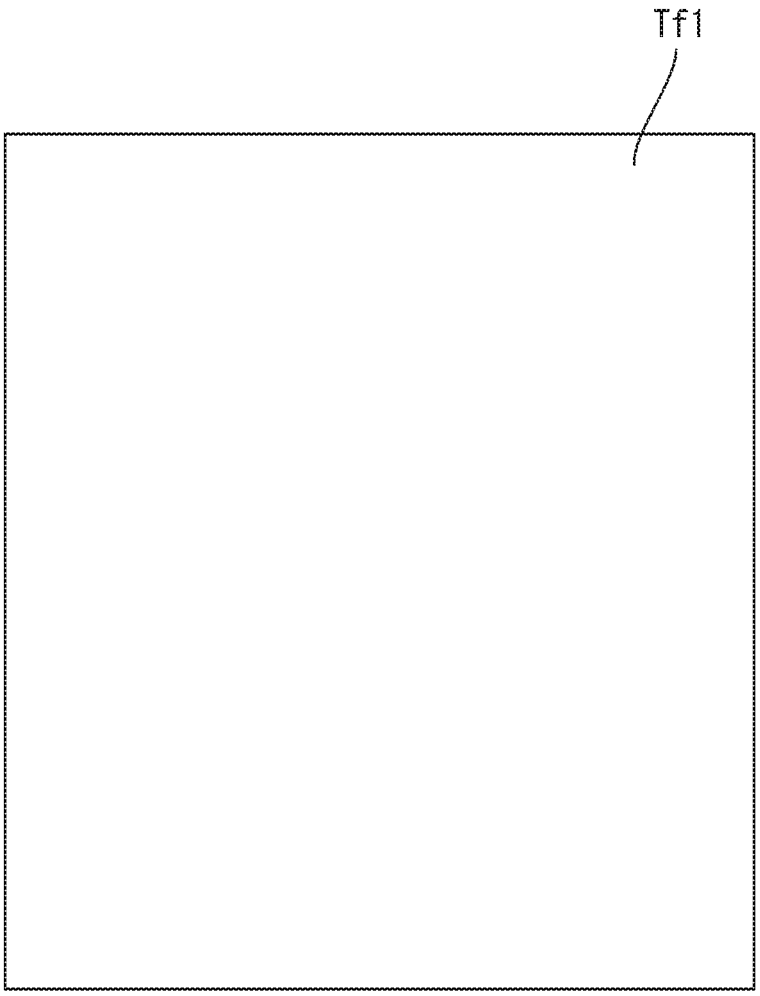
FIG. 2 is a plan view of a female terminal of Embodiment 1.

As shown in FIG. 2, the female terminal Tf1 is a flat plate-shaped member that is constituted by a conductive material, such as metal, and is connected to a male terminal Tm (corresponding to a partner terminal) via the contacts C.

Figure 3:
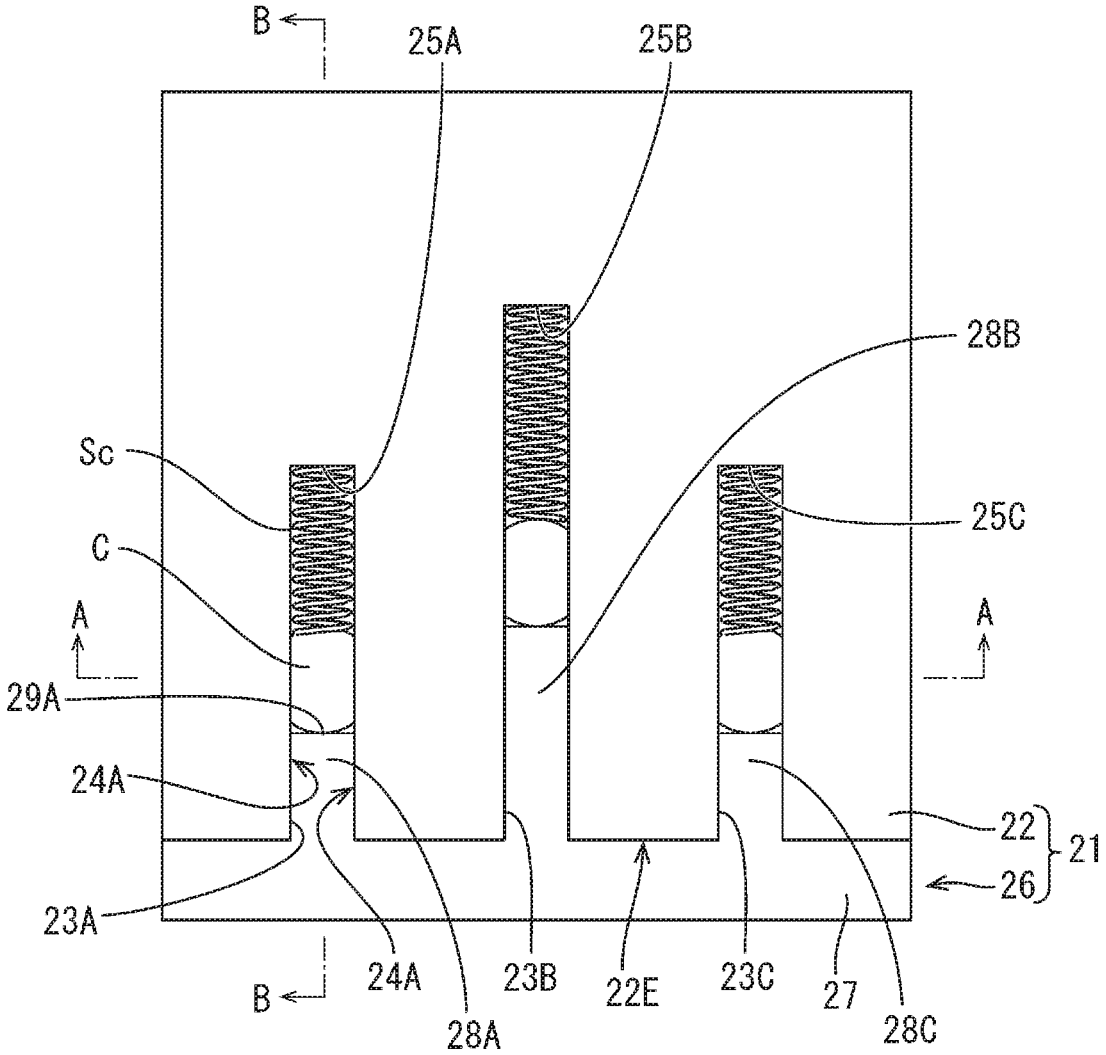
FIG. 3 is a plan view showing a state in which contacts and compression coil springs are held in a contact holder in Embodiment 1.
Figure 4:
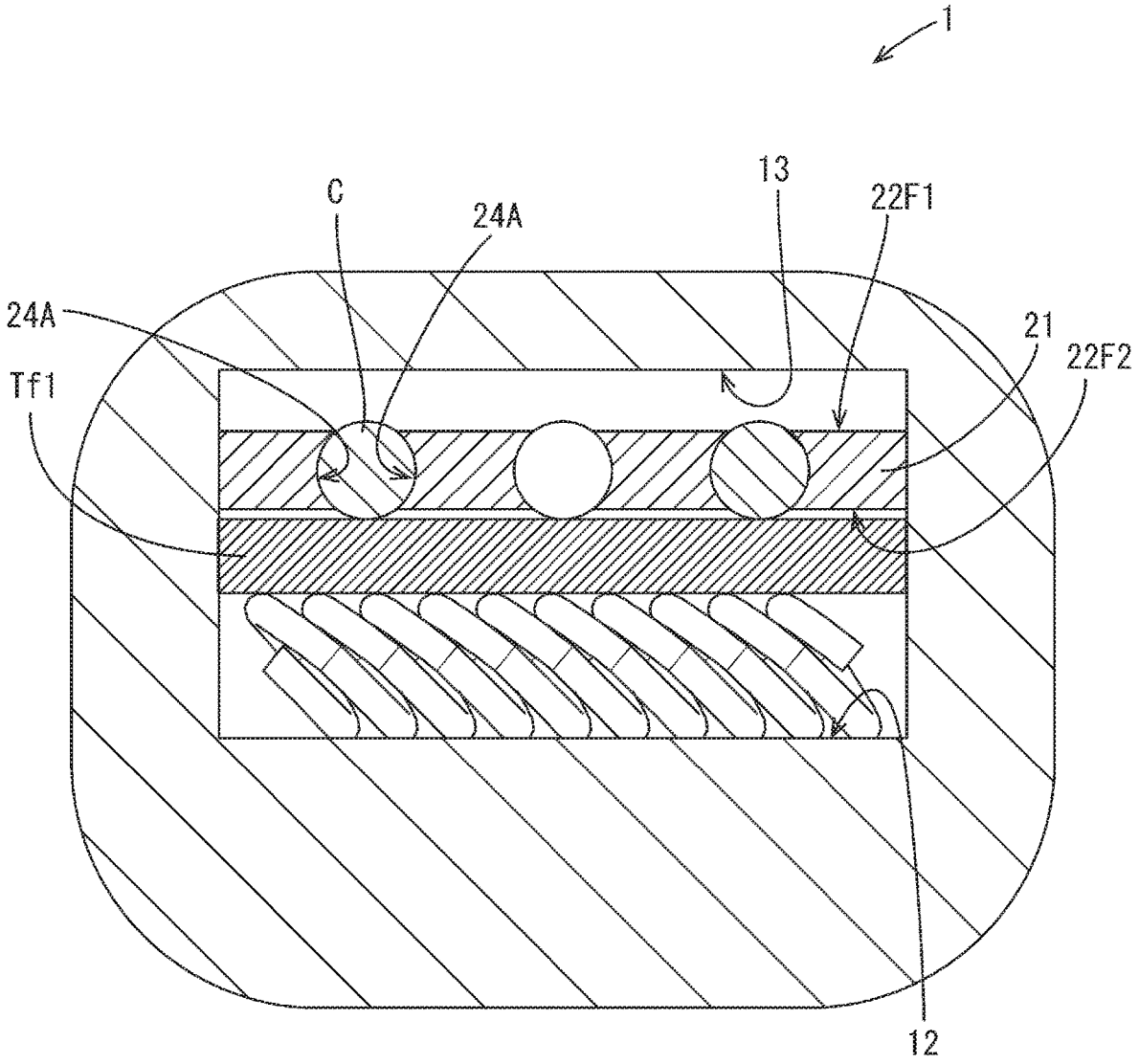
FIG. 4 is a cross-sectional view of the connector of Embodiment 1, which is cut at the same position as line A-A in FIG. 3.
Figure 8:
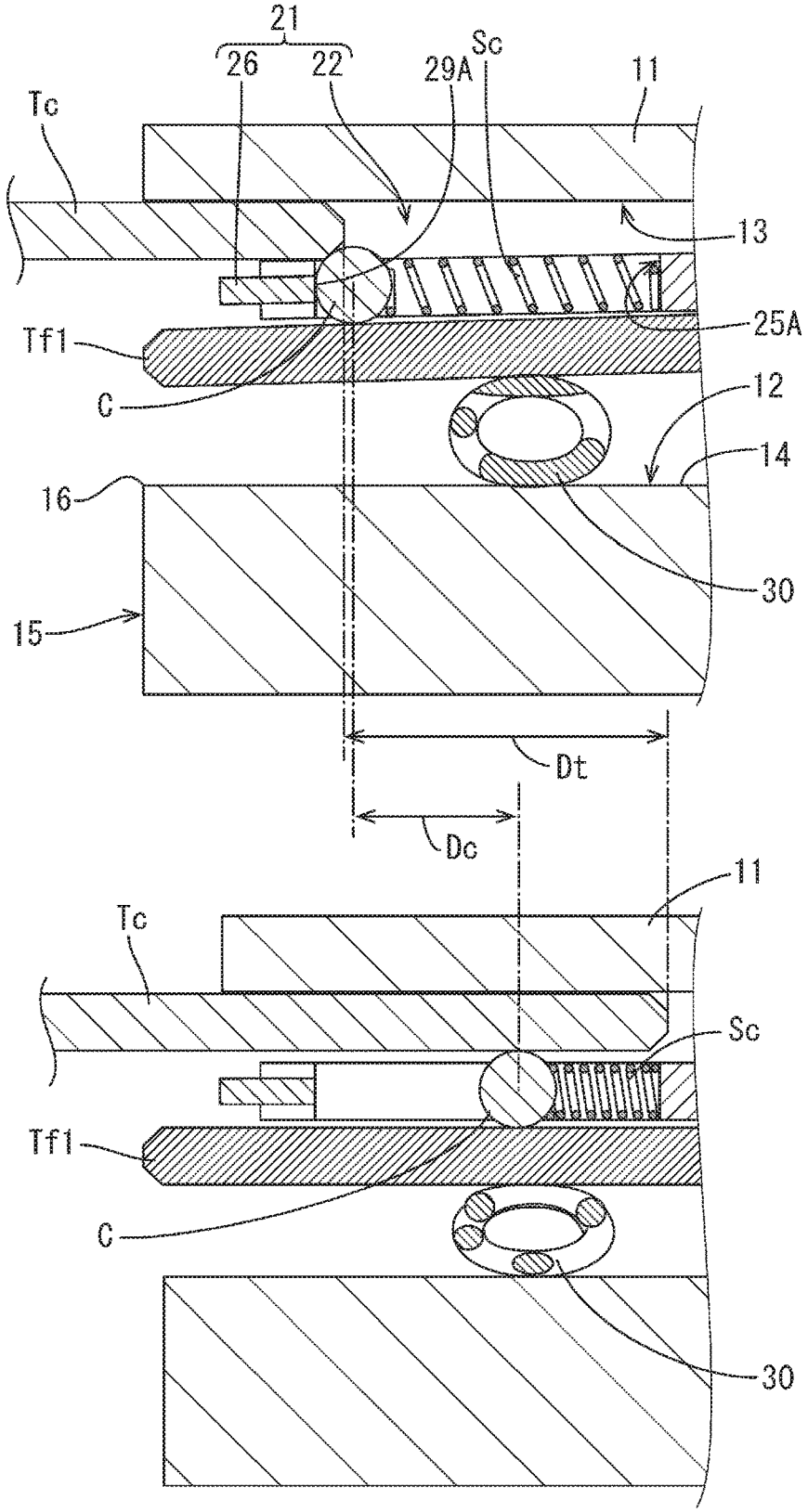
FIG. 8 is a cross-sectional view of the connector of Embodiment 1, which is cut at the same position as line B-B in FIG. 3, and shows a state of rolling movement of a contact accompanying insertion of the male terminal.
Figure 9:
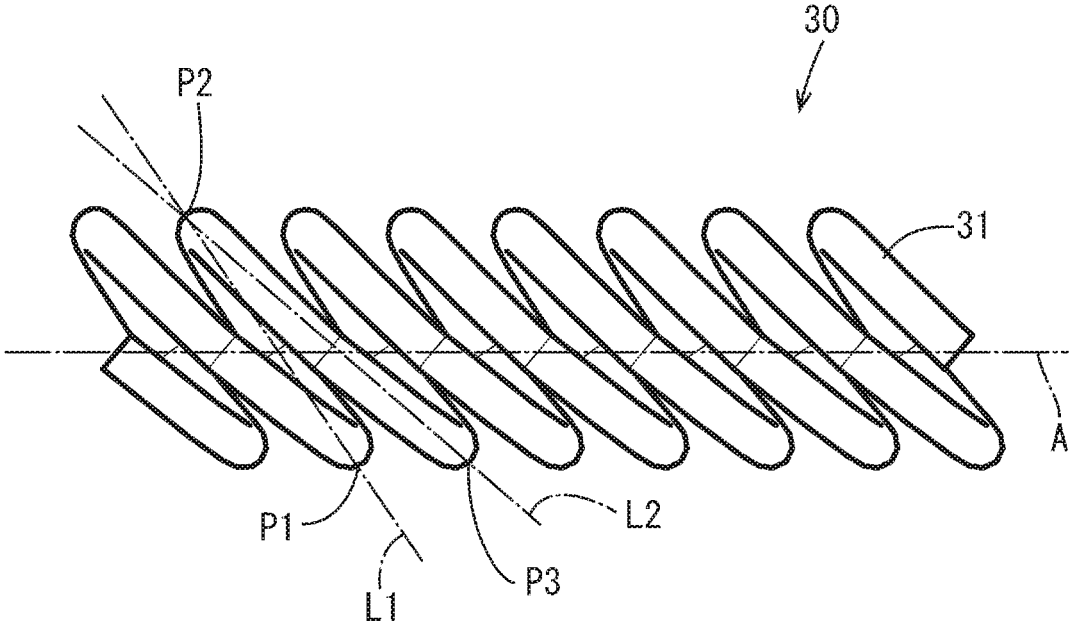
FIG. 9 is a side view showing a diagonally wound coil spring of Embodiment 1.
Figure 10:
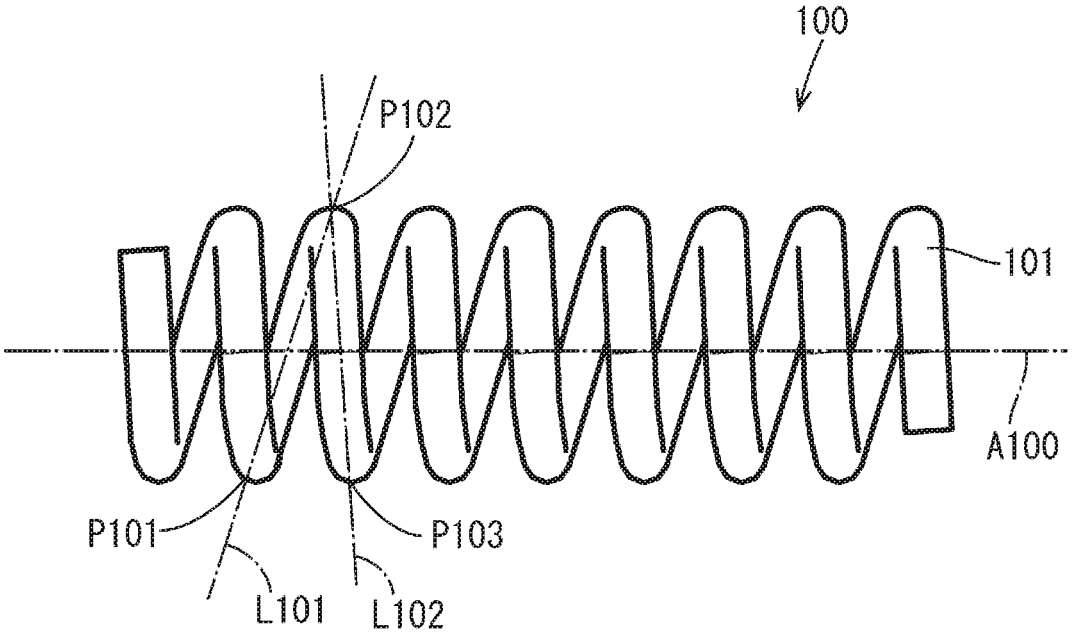
FIG. 10 is a side view showing a coil spring that has an ordinary shape.

As shown in FIGS. 4 and 8, the contacts C are balls that are constituted by a conductive material, such as metal. As shown in FIGS. 3 and 8, the compression coil springs Sc have an ordinary shape that is formed by winding a wire a plurality of turns around an axis, and have a slightly smaller outer diameter than the outer diameter of the contacts C.

Figure 1:
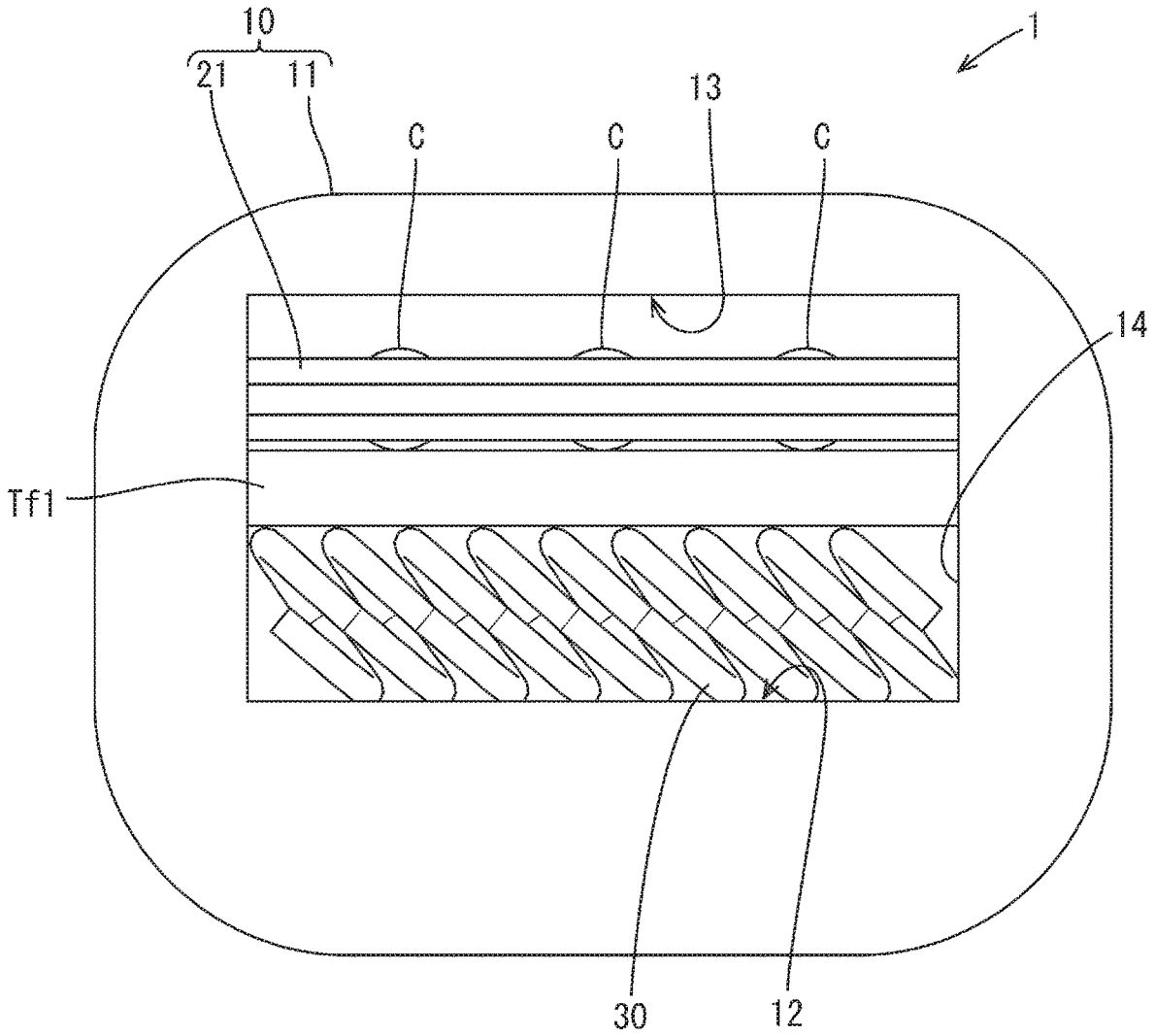
FIG. 1 is a front view of a connector of Embodiment 1.

The connector housing 10 is made of a synthetic resin, and includes a housing main body 11 and a contact holder 21 (corresponding to a contact holding portion) that is attached to the housing main body 11, as shown in FIG. 1.

The housing main body 11 includes a terminal housing chamber 14 that is defined by a pair of inner walls (a spring receiving wall 12 and a male terminal receiving wall 13) that face each other. As shown in FIG. 8, the terminal housing chamber 14 has an opening (a terminal insertion port 16) in one surface (a terminal insertion surface 15) of the plurality of outer surfaces of the housing main body 11.

Figure 7:
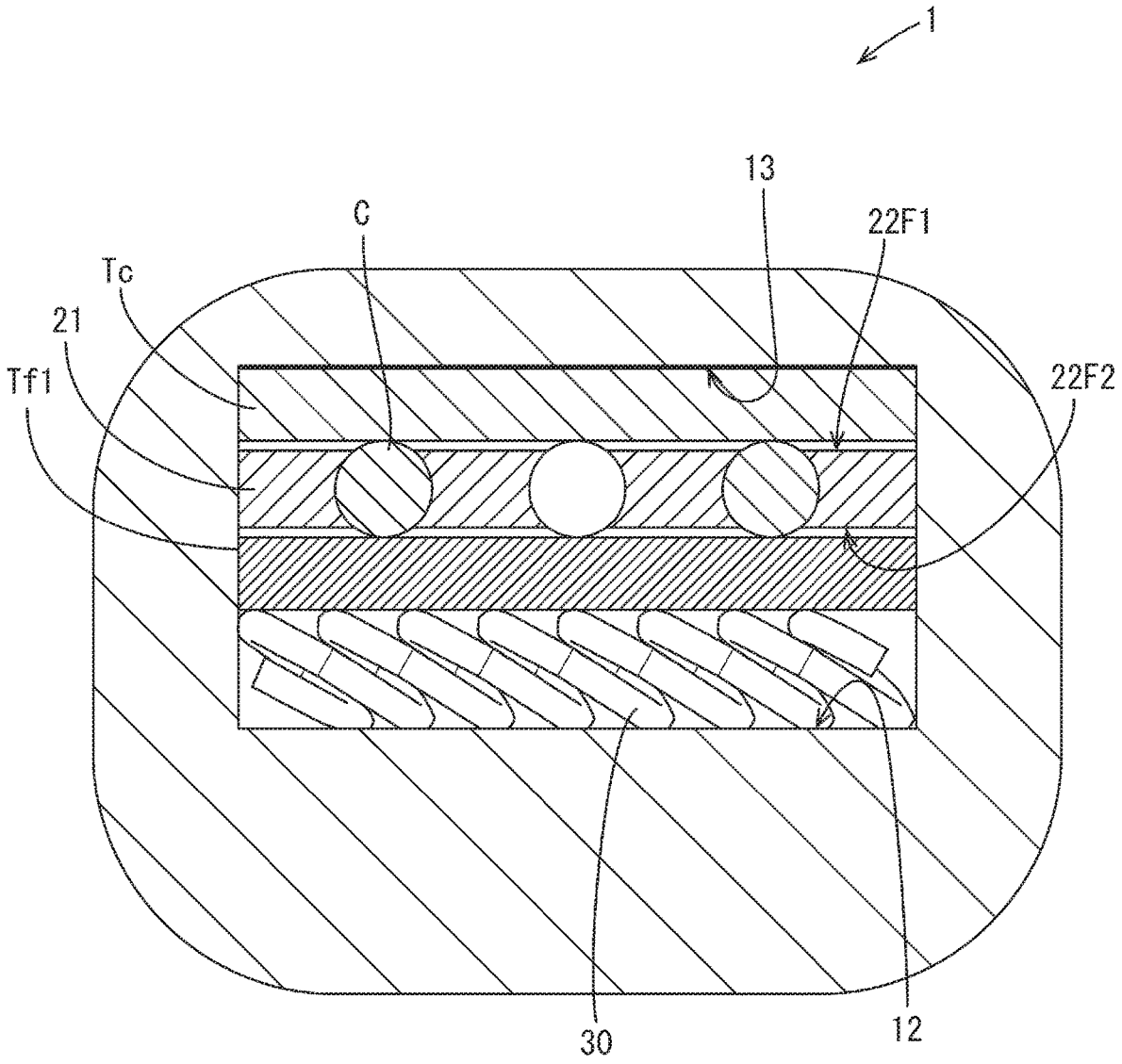
FIG. 7 is a cross-sectional view of the connector of Embodiment 1, into which the male terminal is inserted and which is cut at the same position as line C-C in FIG. 6.

The contact holder 21 is made of a synthetic resin, and includes a holder main body 22 and a cap 26, as shown in FIG. 3. The holder main body 22 is a rectangular plate-shaped member that has a slightly smaller thickness than the diameter of the contacts C, and, as shown in FIG. 7, one surface of the front and back surfaces of the holder main body 22 is a male terminal facing surface 22F1 that faces the male terminal Tm, and the other surface is a female terminal facing surface 22F2 that faces the female terminal Tf1.

As shown in FIG. 3, the holder main body 22 includes three contact housing portions 23A, 23B, and 23C.

Out of the three contact housing portions 23A, 23B, and 23C, the contact housing portion 23A that is located at one end (left end in FIG. 3) is a slit-shaped cutout that is defined by a pair of side walls 24A that face each other and extend perpendicularly from an end surface (a cap attachment surface 22E) constituting one side of the holder main body 22 and an innermost wall 25A that connects the pair of side walls 24A. As shown in FIG. 4, each side wall 24A has a curved surface that is recessed in a direction away from the other side wall 24A, and the curved shape of the side walls 24A conforms to an arc that corresponds to the surface of the contact C.

The contact housing portion 23C that is located at the other end (right end in FIG. 3) has the same configuration as that of the contact housing portion 23A.

The configuration of the contact housing portion 23B that is located at the middle is the same as that of the contact housing portion 23A, other than the position of the innermost wall 25B. As shown in FIG. 3, the distance from the cap attachment surface 22E to the innermost wall 25B is longer than the distance from the cap attachment surface 22E to the innermost walls 25A and 25C of the contact housing portions 23A and 23C.

The cap 26 includes a band-shaped cap main body 27 that extends along the cap attachment surface 22E and plate-shaped restriction portions 28A, 28B, and 28C that extend from the cap main body 27 and enter the three contact housing portions 23A, 23B, and 23C, respectively. The restriction portion 28B that is located at the middle is longer than the other two restriction portions 28A and 28C.

As shown in FIG. 3, one compression coil spring Sc and one contact C are held within the contact housing portion 23A in a state of being sandwiched between the pair of side walls 24A. As shown in FIG. 3, the restriction portion 28A keeps the contact C and the compression coil spring Sc from falling off. The compression coil spring Sc is arranged adjacent to the innermost wall 25A, and the contact C is arranged adjacent to the restriction portion 28A. The inside space of the contact housing portion 23A serves as a movement path of the contact C, and the contact C can roll along the pair of side walls 24A. The restriction portion 28A has a protruding end that serves as a restriction wall 29A that abuts against the contact C and thus restricts the contact C from moving further in a direction toward the terminal insertion surface 15. The compression coil spring Sc is in a slightly elastically compressed state with one end thereof abutting against the contact C and the other end thereof abutting against the innermost wall 25A, and is biasing the contact C toward the restriction wall 29A.

The holder main body 22 has a slightly smaller thickness than the diameter of the contacts C, and accordingly the contacts C slightly protrude outward from the male terminal facing surface 22F1 and the female terminal facing surface 22F2, as shown in FIG. 4.

Likewise, one compression coil spring Sc and one contact C are held in each of the other two contact housing portions 23B and 23C. As described above, with regard to the middle contact housing portion 23B, the distance from the cap attachment surface 22E to the innermost wall 25B is longer than the distance from the cap attachment surface 22E to the innermost walls 25A and 25C of the contact housing portions 23A and 23C, and the restriction portion 28B is longer than the other two restriction portions 28A and 28C. Therefore, the contact C housed in the middle contact housing portion 23B is arranged farther away from the cap attachment surface 22E than the contacts C housed in the other two contact housing portions 23A and 23C are.

The diagonally wound coil spring 30 has a coil shape that is formed by winding a wire 31 a plurality of turns. Unlike an ordinary coil spring 100, the diagonally wound coil spring 30 is obtained by winding the wire 31 so as to incline in one direction relative to a coil axis A (corresponding to its axis). In the ordinary coil spring 100 shown in FIG. 10, a straight line L101 that connects an arbitrary point P101 on a wire 101 and a point P102 that is spaced from the point P101 by a half turn and a straight line L102 that connects the point P102 and a point P103 that is spaced from the point P102 by a half turn are inclined in opposite directions relative to a coil axis A100. In contrast, in the diagonally wound coil spring 30 shown in FIG. 9, a straight line L1 that connects an arbitrary point P1 on the wire 31 and a point P2 that is spaced from the point P1 by a half turn and a straight line L2 that connects the point P2 and a point P3 that is spaced from the point P2 by a half turn are inclined in the same direction relative to the coil axis A.

If a load is applied to the diagonally wound coil spring 30 configured as described above in a direction that is perpendicular to the coil axis A, the diagonally wound coil spring 30 deforms such that coil loops fall over so as to further incline relative to the coil axis A and the height of the spring (length in the direction perpendicular to the coil axis A) decreases.

As shown in FIGS. 1 and 4, the diagonally wound coil spring 30, the female terminal Tf1, and the contact holder 21 are housed in the terminal housing chamber 14 in a state of being overlaid on each other in this order. The diagonally wound coil spring 30 is arranged so as to abut against the spring receiving wall 12. The female terminal Tf1 is arranged in parallel to the spring receiving wall 12 and abuts against the diagonally wound coil spring 30. The contact holder 21 is arranged in parallel to the female terminal Tf1 such that the female terminal facing surface 22F2 faces the female terminal Tf1, and the three contacts C protruding from the female terminal facing surface 22F2 abut against the female terminal Tf1. As shown in FIG. 8, the contact holder 21 is attached such that the side to which the cap 26 is attached faces the terminal insertion surface 15. Thus, the contacts C are allowed to roll in a direction toward the terminal insertion surface 15 and a direction away from the terminal insertion surface 15. Further, the restriction wall 29A is located in one end portion that is closer to the terminal insertion surface 15, out of opposite end portions of the movement path of the contact C, and restricts the contact C from moving further in the direction toward the terminal insertion surface 15.

Figure 5:
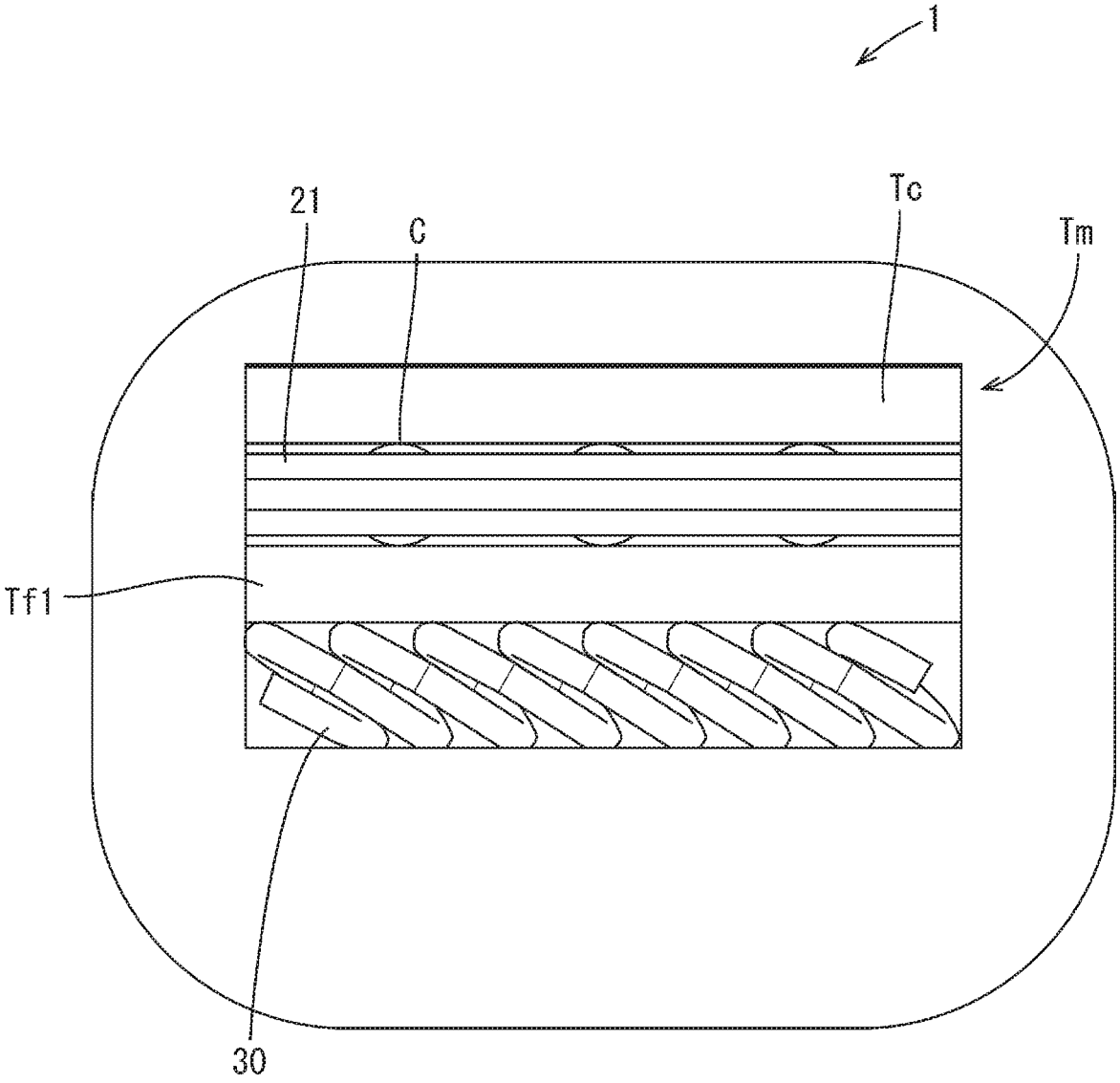
FIG. 5 is a front view showing a state in which a male terminal is inserted into the connector of Embodiment 1.
Figure 6:
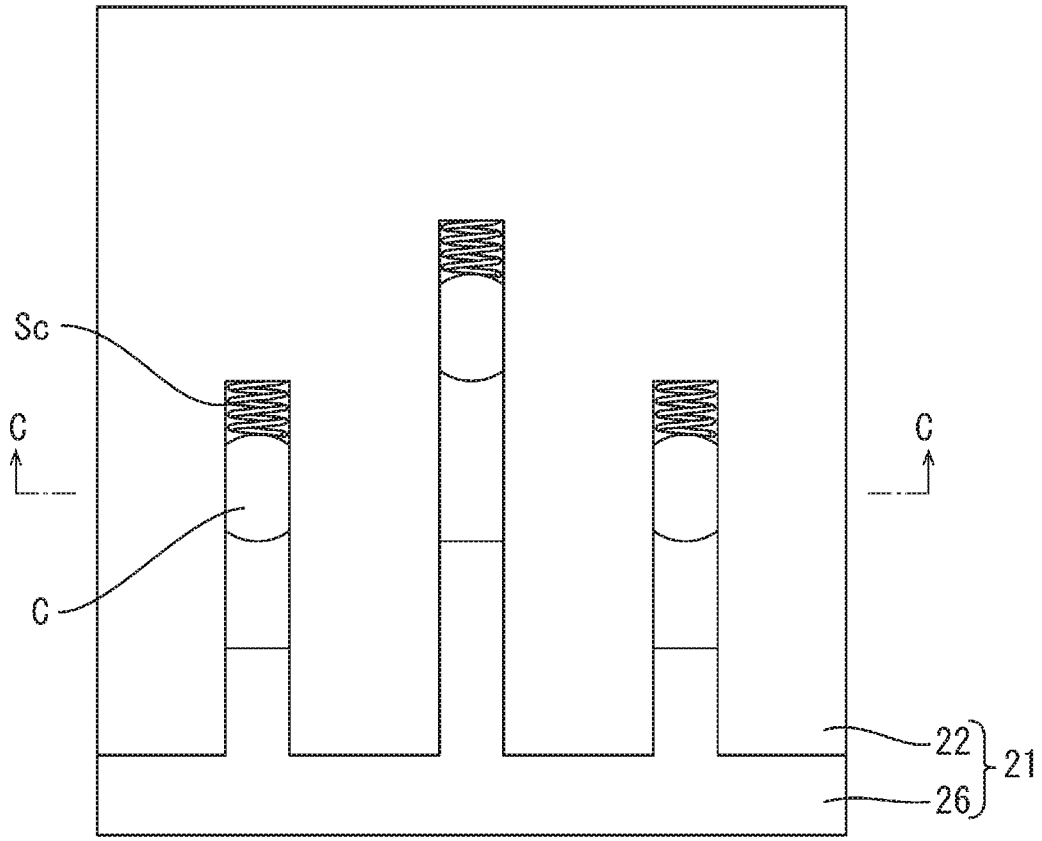
FIG. 6 is a plan view showing a state of the contacts and the compression coil springs held in the contact holder when the male terminal is inserted into the connector of Embodiment 1.

The male terminal Tm is a member that is constituted by a conductive material, such as metal, and includes a flat-plate shaped terminal connecting portion Tc that is electrically connected to the female terminal Tf1, as shown in FIGS. 5, 7, and 8.

The following describes movement of the contact C at the time of inserting the male terminal Tm, using the contact C housed in the contact housing portion 23A as an example. Movement of the contacts C housed in the contact housing portions 23B and 23C is the same as that of the contact C housed in the contact housing portion 23A, and therefore a description thereof is omitted.

As shown in FIG. 4, in a state in which the male terminal Tm is not inserted into the connector housing 10, there is a gap between the male terminal receiving wall 13 and the contact C protruding from the male terminal facing surface 22F1 of the contact holder 21. The distance between the contact C and the male terminal receiving wall 13 is slightly smaller than the thickness of the terminal connecting portion Tc.

If some force is applied to the contact C and the contact C moves toward the innermost wall 25A, the compression coil spring Sc is further elastically compressed and presses the contact C back toward the restriction wall 29A using an elastic restoring force. Thus, the contact C is held at a position at which the contact C abuts against the restriction wall 29A.

As shown in FIG. 8, when the male terminal Tm is inserted into the connector housing 10, the terminal connecting portion Tc enters the terminal housing chamber 14 from the terminal insertion port 16 along the male terminal receiving wall 13, and comes into contact with the contact C. As the terminal connecting portion Tc further moves toward the innermost side, the contact C rolls toward the innermost side accompanying the movement of the terminal connecting portion Tc. Thus, resistance against insertion of the terminal connecting portion Tc can be reduced.

Here, if the contact C becomes unable to further roll before the insertion operation of the terminal connecting portion Tc is completed, it is no longer possible to achieve the insertion resistance reducing effect. Furthermore, there is a risk that sliding friction will occur between the contact C and the terminal connecting portion Tc. In order to avoid such a situation, in the present embodiment, the distance by which the contact C can roll is made sufficiently long relative to an insertion stroke of the terminal connecting portion Tc relative to the connector housing 10. This will be described specifically below.

As described above, in a state in which the male terminal Tm is not inserted, the contact C is held at an initial position (position shown in the upper diagram in FIG. 8) at which the contact C abuts against the restriction wall 29A. If an external force toward the innermost wall 25A is applied to the contact C, the contact C can roll toward the innermost wall 25A until the compression coil spring Sc is compressed between the contact C and the innermost wall 25A and enters a state in which coil loops are in close contact with each other. Accordingly, the maximum distance by which the contact C can move from the initial position toward the innermost wall 25A is equal to a difference between the length (initial length) of the compression coil spring Sc in a state of biasing the contact C so as to abut against the restriction wall 29A and a close-contact length of the compression coil spring Sc (i.e., the length of the compression coil spring Sc that is compressed by applying a load until coil loops come into close contact with each other).

On the other hand, a movement distance Dc of the contact C accompanying the insertion of the male terminal Tm is about half the insertion stroke of the male terminal Tm. Specifically, the movement distance Dc of the contact C is about half a movement distance Dt from a position (insertion start position: position shown in the upper diagram in FIG. 8) at which the terminal connecting portion Tc entering the terminal housing chamber 14 abuts against the contact C located at the initial position to a normal insertion completion position (position shown in the lower diagram in FIG. 8) of the terminal connecting portion Tc. This can be derived from a relationship between a movement distance of a movable pulley and a distance by which a string is pulled when the movable pulley operates. That is, when a suspended load is pulled up using a movable pulley, the movement distance of the movable pulley is half the length by which a string is pulled. Likewise, assuming that the contact C is the moveable pulley and the terminal connecting portion Tc is a portion of the string, the movement distance Dc of the contact C is half the movement distance Dt of the terminal connecting portion Tc.

Therefore, if the difference between the initial length of the compression coil spring Sc and its close-contact length is made larger than half the movement distance Dt of the terminal connecting portion Tc, the contact C can be reliably caused to roll and the insertion resistance reducing effect and the sliding friction reducing effect can be continuously achieved from an initial stage to a final stage of the insertion operation of the male terminal Tm.

As shown in FIG. 7, in a state in which the male terminal Tm is inserted to its normal position relative to the connector housing 10, the terminal connecting portion Tc is arranged so as to abut against the male terminal receiving wall 13, and the contacts C are sandwiched between the terminal connecting portion Tc and the female terminal Tf1. As a result of the terminal connecting portion Tc being inserted, the contacts C and the female terminal Tf1 are pressed toward the spring receiving wall 12, and the diagonally wound coil spring 30 deforms such that the coil loops fall over so as to further incline relative to the coil axis A and the height of the spring (length in the direction perpendicular to the coil axis A) decreases. An elastic restoring force of the diagonally wound coil spring 30 makes the contacts C come into contact with the female terminal Tf1 and the terminal connecting portion Tc under a constant contact pressure, and the female terminal Tf1 and the male terminal Tm are electrically connected to each other.

Note that the contact C housed in the middle contact housing portion 23B is located farther away from the cap attachment surface 22E than the contacts C housed in the other two contact housing portions 23A and 23C, as described above. As a result of the three contacts C being not aligned along a straight line, the female terminal Tf1 and the terminal connecting portion Tc can be prevented from inclining relative to the contact holder 21, and the postures of the female terminal Tf1 and the terminal connecting portion Tc can be stabilized.

As described above, according to the present embodiment, the connector 1 includes: the connector housing 10 that includes the terminal housing chamber 14 that has the terminal insertion port 16 in the terminal insertion surface 15 and is capable of housing the male terminal Tm; the female terminal Tf1 that is housed in the terminal housing chamber 14 and is electrically connectable to the male terminal Tm; and the contacts C that are housed in the terminal housing chamber 14 and are in contact with the female terminal Tf1. The connector housing 10 includes the contact holder 21 that holds the contacts C such that the contacts C can roll in the direction toward the terminal insertion surface 15 and the direction away from the terminal insertion surface 15. In the contact holder 21, the restriction wall 29A that abuts against the contact C and restricts movement of the contact C in the direction toward the terminal insertion surface 15 is arranged in the end portion that is closer to the terminal insertion surface 15, out of the opposite end portions of the movement path of the contact C, and the compression coil spring Sc that biases the contact C toward the restriction wall 29A is held in the contact holder 21. Provided that the initial length of the compression coil spring Sc is the length in a state of biasing the contact C so as to abut against the restriction wall 29A, the difference between the initial length of the compression coil spring Sc and its close-contact length is larger than half the movement distance from the insertion start position at which the male terminal Tm abuts against the contact C abutting against the restriction wall 29A to the insertion completion position at which the insertion of the male terminal Tm into the connector housing 10 is completed.

With this configuration, the contact C can be prevented from becoming unable to roll during the insertion operation of the male terminal Tm, and the insertion resistance reducing effect and the sliding friction reducing effect can be continuously achieved from an initial stage to a final stage of the insertion operation of the male terminal Tm.

Furthermore, the connector 1 includes the diagonally wound coil spring 30 that is housed in the terminal housing chamber 14 and biases the female terminal Tf1 toward the contacts C and the male terminal Tm. With this configuration, the female terminal Tf1, the contacts C, and the male terminal Tm can be brought into contact with each other under a constant contact pressure using the biasing force of the diagonally wound coil spring 30, and electrical connection between the female terminal Tf1 and the male terminal Tm can be reliably realized.

Embodiment 2

Figure 11:
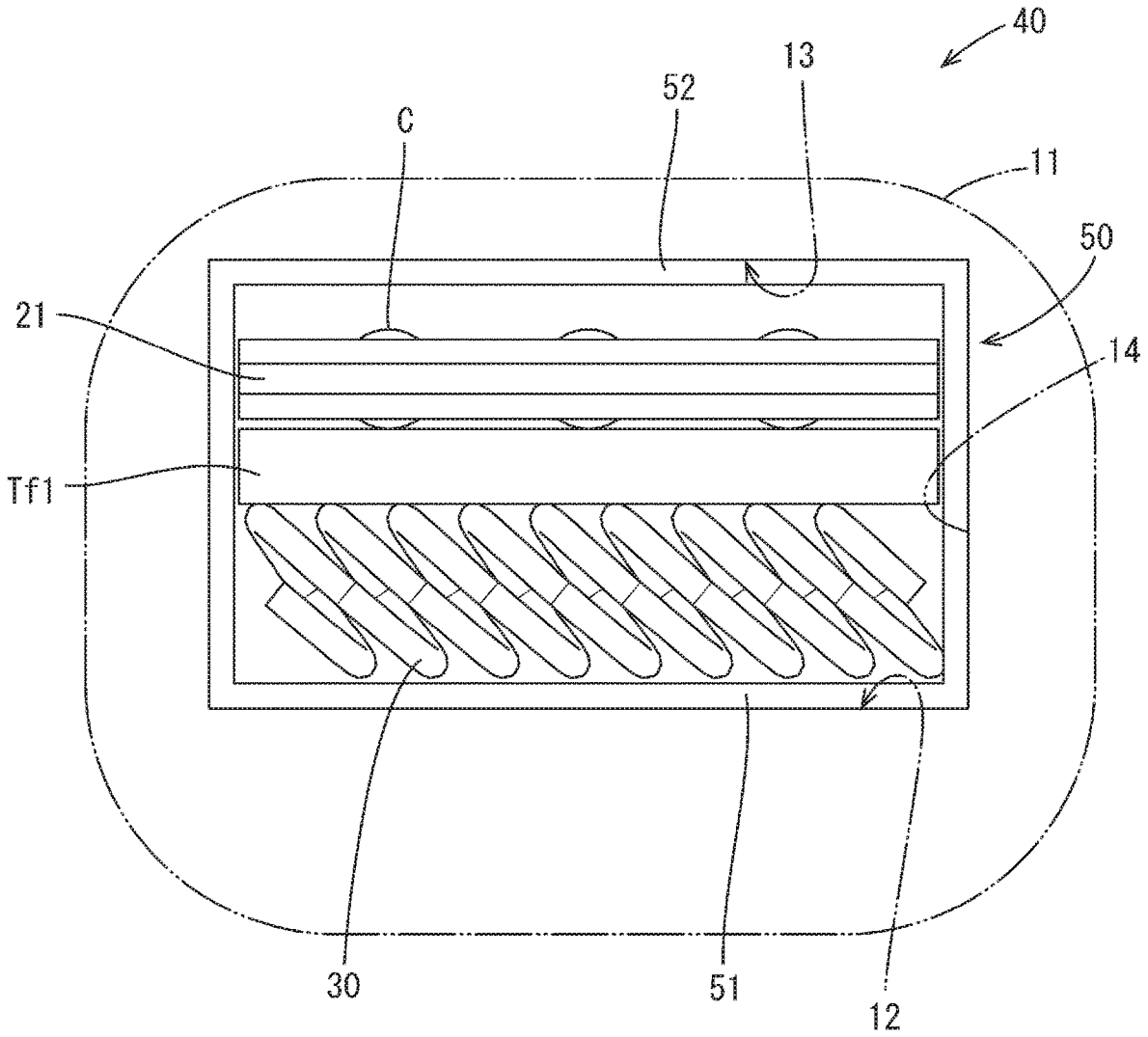
FIG. 11 is a front view of a connector of Embodiment 2.
Figure 12:
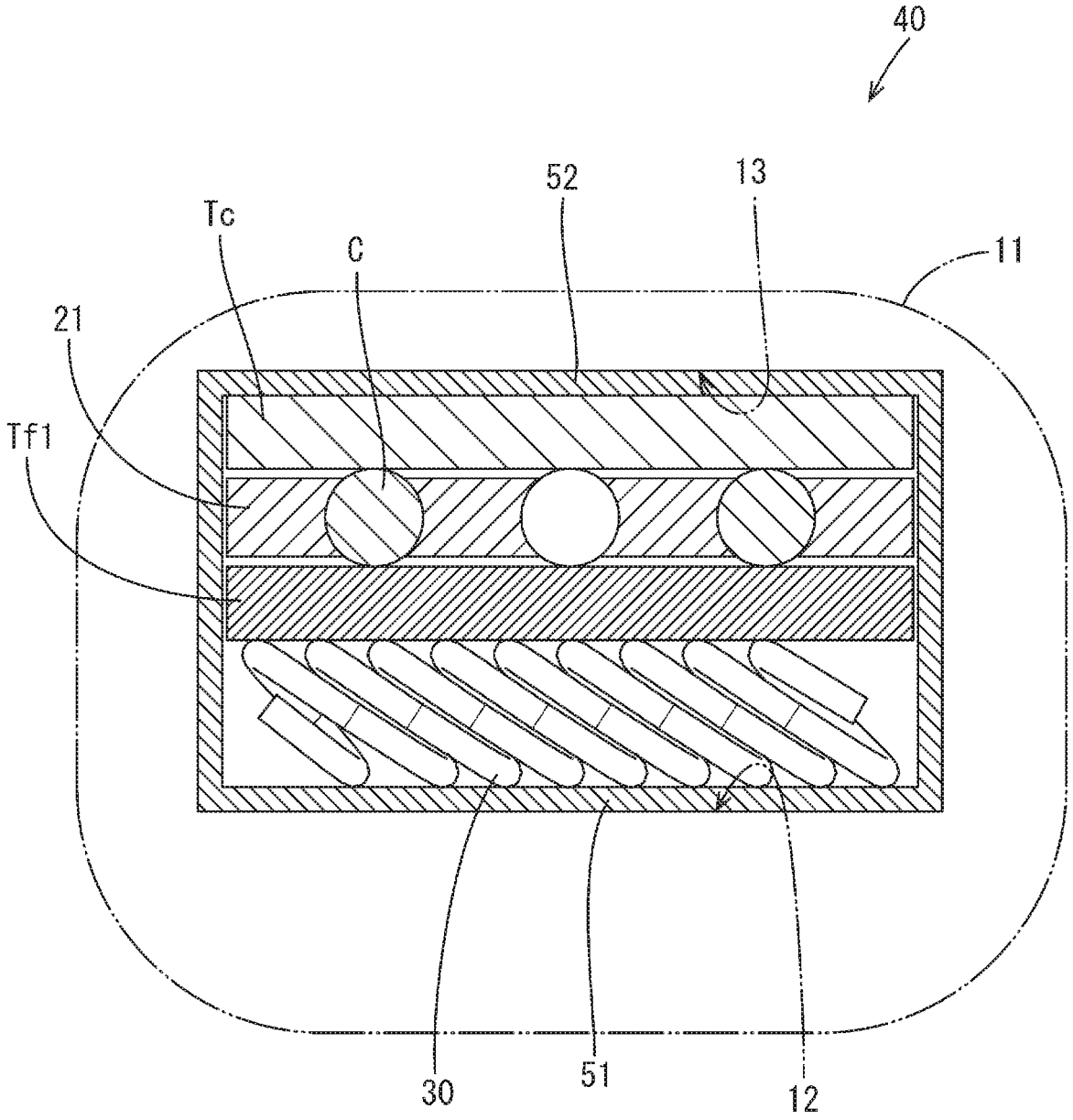
FIG. 12 is a cross-sectional view of the connector of Embodiment 2, into which the male terminal is inserted and which is cut at the same position as line C-C in FIG. 6.
Figure 13:
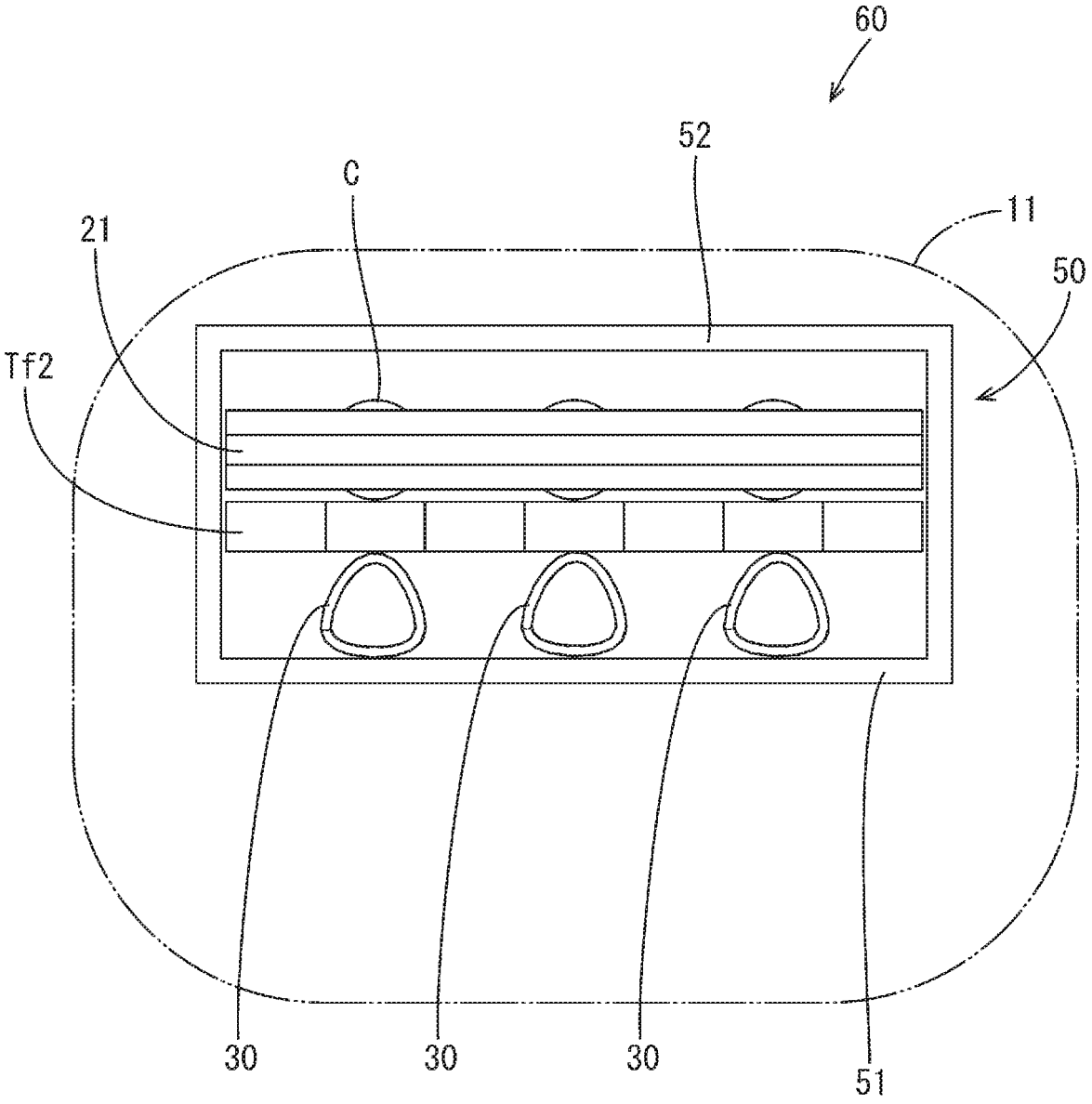
FIG. 13 is a front view of a connector of Embodiment 3.

Embodiment 2 will be described with reference to FIGS. 11 and 12. A connector 40 according to the present embodiment differs from Embodiment 1 in that a metal case 50 (corresponding to a cushioning member) is attached to the inner side of the housing main body 11.

The metal case 50 is a rectangular tube-shaped member made of metal, housed in the terminal housing chamber 14, and arranged so as to surround the female terminal Tf1, the contact holder 21, and the diagonally wound coil spring 30. Out of the four wall portions that constitute the rectangular tube-shaped metal case 50, one wall portion serves as a spring cushioning wall 51 that abuts against the spring receiving wall 12, and another wall portion that is parallel to the one wall portion serves as a terminal cushioning wall 52 that abuts against the male terminal receiving wall 13. The diagonally wound coil spring 30 is arranged so as to abut against the spring cushioning wall 51. In a state in which the male terminal Tm is not inserted into the connector housing 10, there is a gap between the terminal cushioning wall 52 and the three contacts C protruding from the male terminal facing surface 22F1 of the contact holder 21, and the distance between the terminal cushioning wall 52 and the three contacts C is slightly smaller than the thickness of the terminal connecting portion Tc.

Other configurations are the same as those in Embodiment 1, and therefore the same configurations are denoted using the same reference numerals as those used in Embodiment 1 and a description thereof is omitted.

When the male terminal Tm is inserted into the connector housing 10, the terminal connecting portion Tc enters the inside of the metal case 50 along the terminal cushioning wall 52, and comes into contact with the contacts C. In a state in which the male terminal Tm is inserted to its normal position relative to the connector housing 10, the diagonally wound coil spring 30 abuts against the spring cushioning wall 51, and the terminal connecting portion Tc abuts against the terminal cushioning wall 52. Similarly to Embodiment 1, as a result of the terminal connecting portion Tc being inserted, the diagonally wound coil spring 30 deforms such that coil loops fall over so as to further incline relative to the coil axis A and the height of the spring (length in the direction perpendicular to the coil axis A) decreases. The elastic restoring force of the diagonally wound coil spring 30 makes the contacts C come into contact with the female terminal Tf1 and the terminal connecting portion Tc under a constant contact pressure, and the female terminal Tf1 and the male terminal Tm are electrically connected to each other.

At this time, the spring cushioning wall 51 takes on a contact pressure from the diagonally wound coil spring 30, and the terminal cushioning wall 52 takes on a contact pressure from the terminal connecting portion Tc. As a result of the metal case 50 being interposed between the connector housing 10 and each of the diagonally wound coil spring 30 and the male terminal Tm as described above, the connector housing 10 can be prevented from directly taking on contact pressures from the diagonally wound coil spring 30 and the male terminal Tm, and creep deformation of the connector housing 10 can be suppressed.

Embodiment 3

Embodiment 3 will be described with reference to FIGS. 13 to 16. The present embodiment differs from Embodiment 1 in the shape of a female terminal Tf2 (corresponding to a terminal fitting). Note that a connector 60 according to the present embodiment includes the metal case 50, similarly to Embodiment 2.

Figure 14:
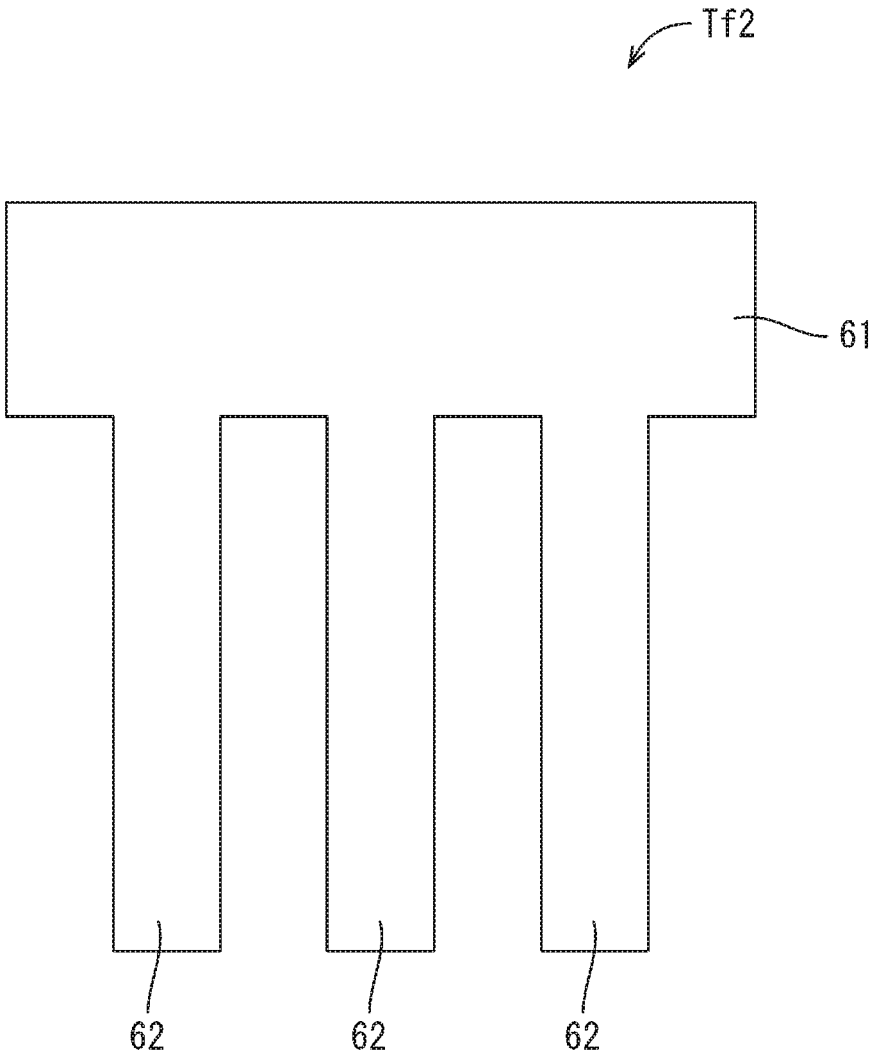
FIG. 14 is a plan view of a female terminal of Embodiment 3.

As shown in FIG. 14, the female terminal Tf2 in this embodiment includes an elongated rectangular plate-shaped base portion 61 and three contact pieces 62 that are continuous from the base portion 61. Each contact piece 62 is an elongated plate-shaped portion that extends perpendicularly from one long side out of two long sides of the base portion 61. The three contact pieces 62 are arranged side by side at constant intervals.

Figure 15:
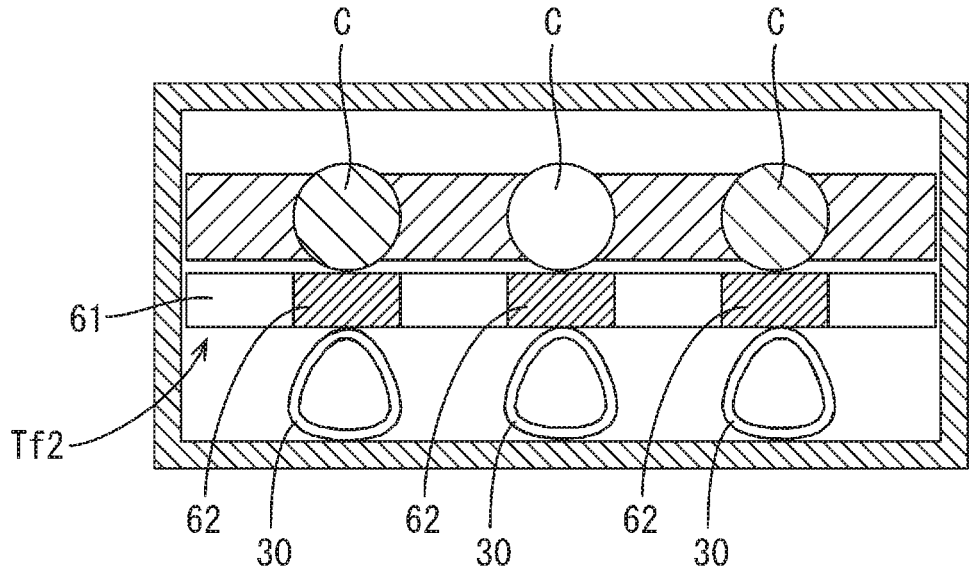
FIG. 15 is a cross-sectional view of the connector of Embodiment 3, which is cut at the same position as line A-A in FIG. 3.

The female terminal Tf2 is arranged such that the base portion 61 is located at the innermost end of the terminal housing chamber 14 and the three contact pieces 62 are oriented in the direction from the innermost end of the terminal housing chamber 14 toward the terminal insertion surface 15. As shown in FIG. 15, one contact C is in contact with one contact piece 62. Further, three diagonally wound coil springs 30 are arranged within the terminal housing chamber 14. As shown in FIG. 15, one diagonally wound coil spring 30 is in contact with one contact piece 62.

Other configurations are the same as those in Embodiments 1 and 2, and therefore the same configurations are denoted using the same reference numerals as those used in Embodiments 1 and 2 and a description thereof is omitted.

Figure 16:
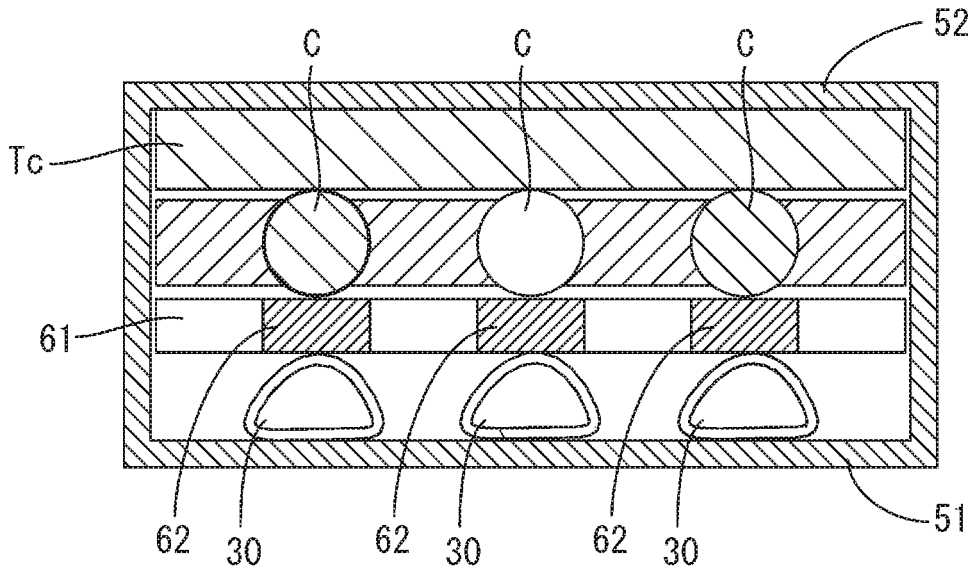
FIG. 16 is a cross-sectional view of the connector of Embodiment 3, into which the male terminal is inserted and which is cut at the same position as line C-C in FIG. 6.
Figure 17:
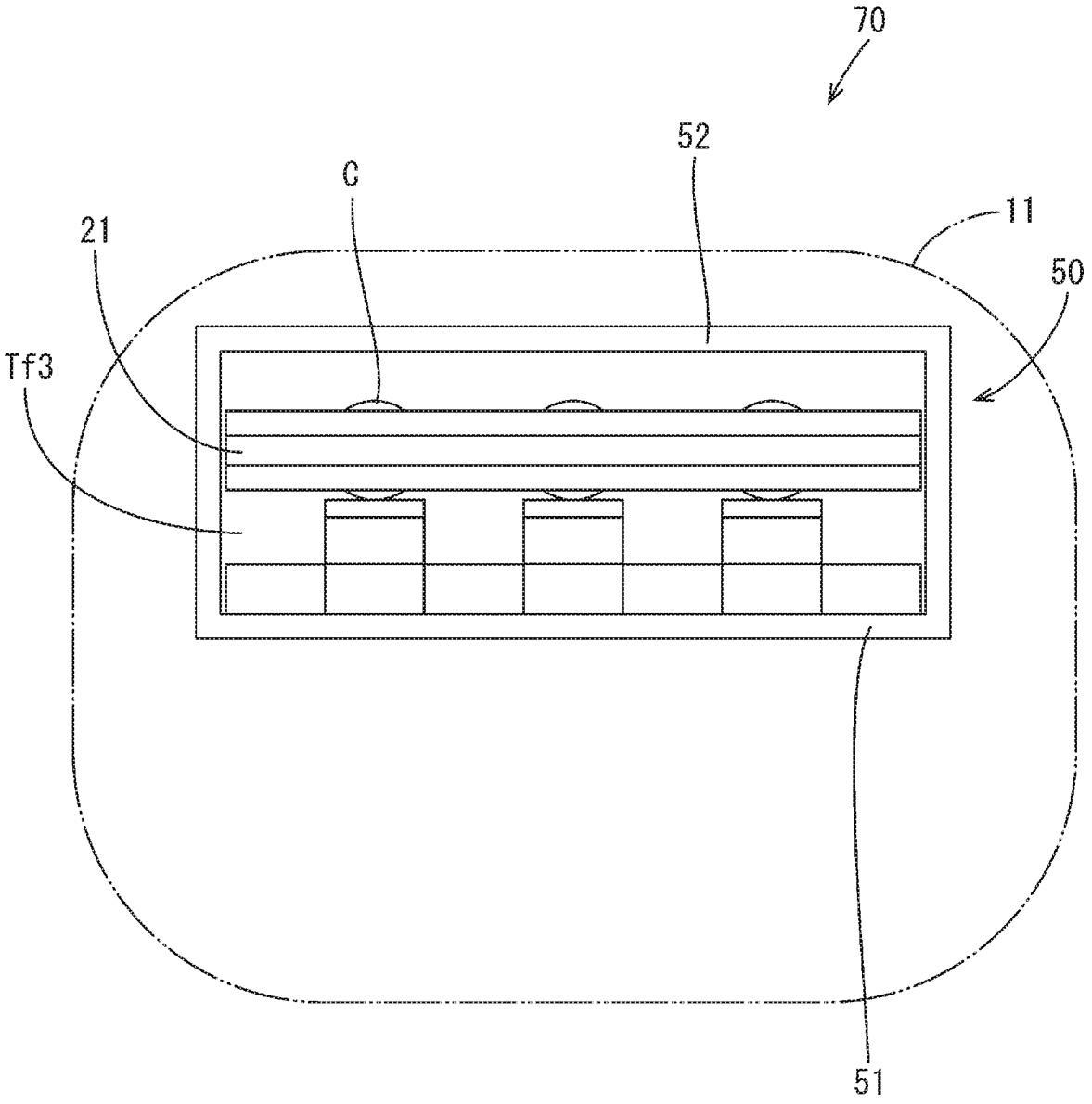
FIG. 17 is a front view of a connector of Embodiment 4.

As shown in FIG. 16, as a result of the terminal connecting portion Tc being inserted, the diagonally wound coil springs 30 each deform such that coil loops fall over so as to further incline relative to the coil axis A and the height of the spring (length in the direction perpendicular to the coil axis A) decreases. The elastic restoring force of the diagonally wound coil springs 30 makes the three contacts C come into contact with the terminal connecting portion Tc and the three contact pieces 62, respectively, under a constant contact pressure, and the female terminal Tf2 and the male terminal Tm are electrically connected to each other.

With this configuration, the three contact pieces 62 can undergo flexure deformation independently of each other, and accordingly, even if there is a difference between the size of the three contacts C due to manufacturing tolerance, all of the contacts C can be reliably brought into contact with the female terminal Tf2.

Embodiment 4

Embodiment 4 will be described with reference to FIGS. 17 to 21. The present embodiment differs from Embodiment 1 in that a connector 70 does not include a diagonally wound coil spring and a female terminal Tf3 (corresponding to a terminal fitting) includes plate spring-shaped contact pieces 72. Note that the connector 70 according to the present embodiment includes the metal case 50, similarly to Embodiment 2.

Figure 18:
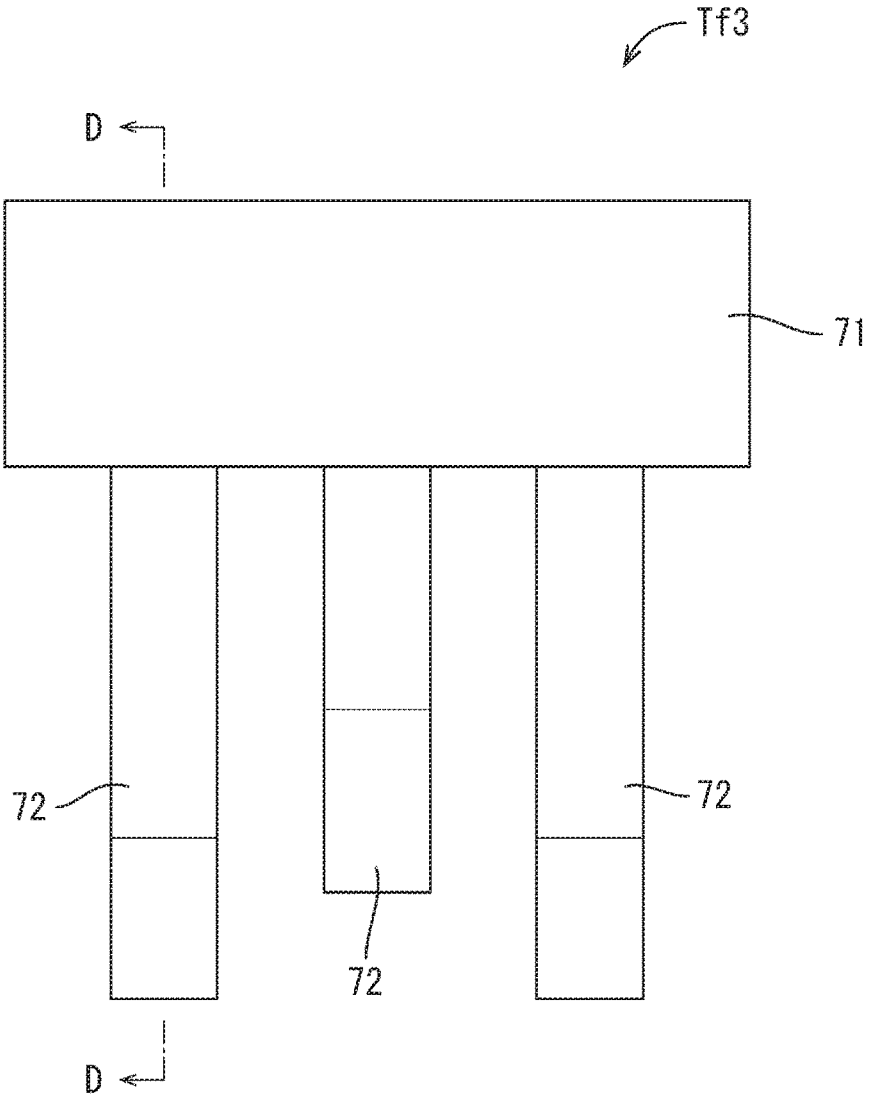
FIG. 18 is a plan view of a female terminal of Embodiment 4.
Figure 19:
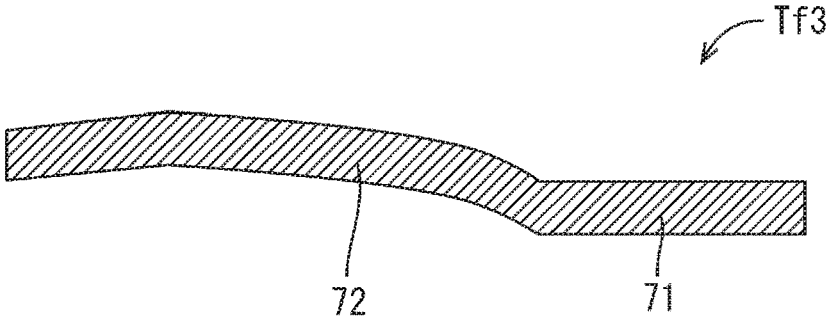
FIG. 19 is a cross-sectional view taken along line D-D in FIG. 18.

As shown in FIG. 18, the female terminal Tf3 in this embodiment includes an elongated rectangular plate-shaped base portion 71 and three contact pieces 72 that are continuous from the base portion 71. Each contact piece 72 is an elongated plate spring-shaped portion that extends perpendicularly from one long side out of two long sides of the base portion 71, and has a mountain shape, as shown in FIG. 19, with a major portion on the side close to the base portion 71 gently inclining relative to the plate surface of the base portion 71 and a remaining portion close to a free end portion extending substantially in parallel to the base portion 71. The three contact pieces 72 are arranged side by side at constant intervals.

Figure 20:
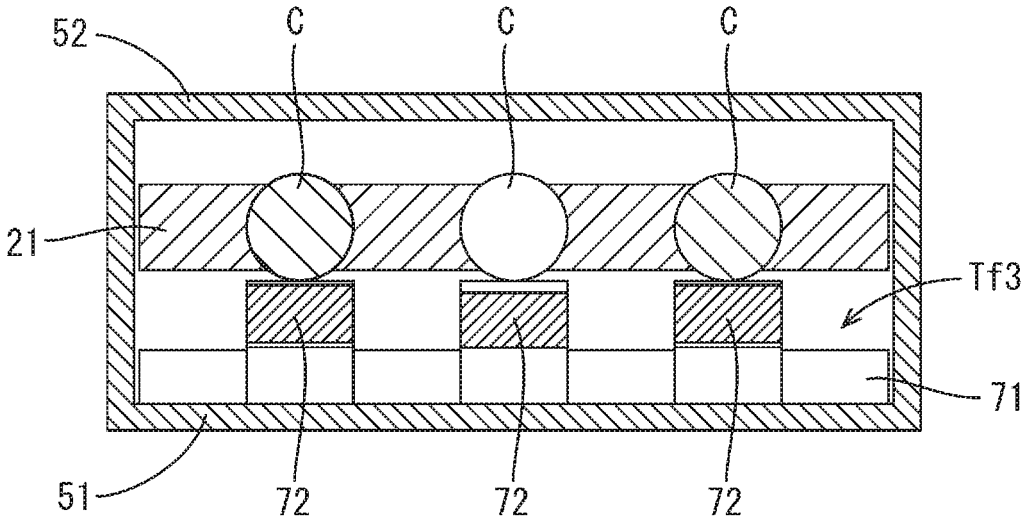
FIG. 20 is a cross-sectional view of the connector of Embodiment 4, which is cut at the same position as line A-A in FIG. 3.

As shown in FIG. 20, the female terminal Tf3 is arranged such that the base portion 71 abuts against the spring cushioning wall 51 and is located at the innermost end of the terminal housing chamber 14, and the three contact pieces 72 are oriented in the direction from the innermost end of the terminal housing chamber 14 toward the terminal insertion surface 15. The contact pieces 72 are arranged such that the top of the mountain shape faces the contact holder 21, and one contact C is in contact with one contact piece 72.

Other configurations are the same as those in Embodiments 1 and 2, and therefore the same configurations are denoted using the same reference numerals as those used in Embodiments 1 and 2 and a description thereof is omitted.

Figure 21:
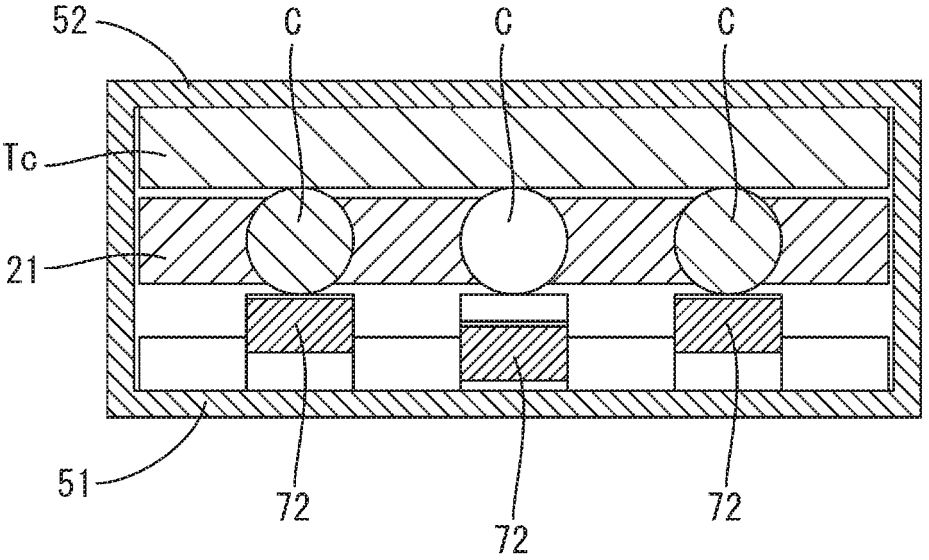
FIG. 21 is a cross-sectional view of the connector of Embodiment 4, into which the male terminal is inserted and which is cut at the same position as line C-C in FIG. 6.

As shown in FIG. 21, when the terminal connecting portion Tc is inserted, the contacts C and the contact pieces 72 are pressed toward the spring cushioning wall 51, and the contact pieces 72 undergo flexure deformation so as to come close to the spring cushioning wall 51. An elastic restoring force of the contact pieces 72 makes the three contacts C come into contact with the terminal connecting portion Tc and the three contact pieces 72, respectively, under a constant contact pressure, and the female terminal Tf3 and the male terminal Tm are electrically connected to each other. As described above, the contact pieces 72 each have the function of a plate spring, and accordingly a diagonally wound coil spring is unnecessary and the configuration of the connector 70 can be simplified.

Variation

Figure 22:
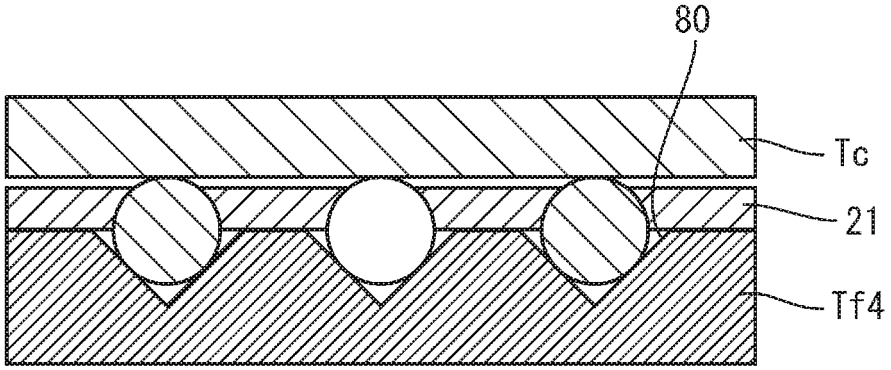
FIG. 22 is a cross-sectional view of a contact holder in which a female terminal according to a variation and contacts are held.

As shown in FIG. 22, a configuration is also possible in which a female terminal Tf4 (corresponding to a terminal fitting) has V-shaped grooves 80 (each corresponding to a groove) that extend along the paths of rolling movement of the contacts C.

Other Embodiments

The technology disclosed in the present specification is not limited to the embodiments described above with reference to the drawings, and also includes various aspects described below, for example.

(1) In the above-described embodiments, the number of contacts C and the number of compression coil springs Sc are each three, but the number of contacts and the number of compression coil springs are not limited to three, and may be two or less or four or more. Also, the number of contact pieces in Embodiments 3 and 4 and the number of diagonally wound coil springs 30 in Embodiment 3 are not limited to those in the above-described embodiments, and are only required to be the same as the number of contacts.

(2) In the above-described embodiments, the contact C housed in the middle contact housing portion 23B is located farther away from the cap attachment surface 22E than the contacts C housed in the other two contact housing portions 23A and 23C, but the arrangement of the plurality of contacts is not limited to that in the above-described embodiments, and, so long as at least three contacts are not aligned along a straight line, postures of the terminal fitting and the partner terminal can be stabilized. In the above-described embodiments, the position of the innermost wall 25B of the middle contact housing portion 23B is shifted from positions of the other innermost walls in order to shift the position of the contact C, but the position of the contact C can also be shifted by changing the length of a compression coil spring housed in a specific contact housing portion from the length of other compression coil springs, for example.

(3) In Embodiments 1, 2, and 3, the diagonally wound coil spring 30 serves as a biasing member, but the type of the biasing member is not limited to that in the above-described embodiments, and the biasing member may be a plate spring, for example.

(4) In Embodiments 2, 3, and 4, the metal case 50 serves as a cushioning member, but the configuration of the cushioning member is not limited to that in the above-described embodiments, and the cushioning member may be metal plates that are arranged between the diagonally wound coil spring and the connector housing and between the male terminal and the connector housing, for example. A configuration is also possible in which the connectors according to Embodiments 3 and 4 do not include a cushioning member.

(5) In the above-described embodiments, the contact holder 21 is provided as a member that is separate from the housing main body 11, but a configuration is also possible in which the contact holding portion and the housing main body are formed as a single piece.

LIST OF REFERENCE NUMERALS

1, 40, 60, 70 Connector
10 Connector housing
14 Terminal housing chamber
15 Terminal insertion surface (one surface)
16 Terminal insertion port (opening)
21 Contact holder (contact holding portion)
29A Restriction wall
30 Diagonally wound coil spring (biasing member)
50 Metal case (cushioning member)
61 Base portion
62 Contact piece
80 V-shaped groove (groove)
C Contact
Sc Compression coil spring
Tf1, Tf2, Tf3, Tf4 Female terminal (terminal fitting)
Tm Male terminal (partner terminal)

The invention claimed is:

1. A connector comprising:

a connector housing that includes a terminal housing chamber that is open in one surface and is configured to house a partner terminal;

a terminal fitting that is housed in the terminal housing chamber and is configured to be electrically connected to the partner terminal; and a contact that is housed in the terminal housing chamber and is in contact with the terminal fitting, wherein the connector housing includes a contact holding portion that holds the contact such that the contact can roll in a direction toward the one surface and in a direction away from the one surface, in the contact holding portion, a restriction wall abuts against the contact and restricts movement of the contact in the direction toward the one surface, the restriction wall being arranged in one end portion that is closer to the one surface, out of opposite end portions of a movement path of the contact, a compression coil spring that biases the contact toward the restriction wall is held in the contact holding portion, and provided that an initial length of the compression coil spring is configured to be a length that biases the contact so as to abut against the restriction wall, a difference between the initial length of the compression coil spring and a close-contact length thereof is larger than half a movement distance from an insertion start position at which the partner terminal abuts against the contact abutting against the restriction wall to an insertion completion position at which insertion of the partner terminal into the connector housing is completed.

2. The connector according to claim 1, wherein the terminal fitting includes a base portion and a plurality of contact pieces that extend from the base portion, a number of contacts that are held in the connector housing is the same as a number of the plurality of contact pieces, and the contacts are in contact with the contact pieces in one-to-one correspondence.

3. The connector according to claim 2, wherein the contact pieces are plate spring portions that bias the contacts toward the partner terminal.

4. The connector according to claim 3, further comprising:

a cushioning member that is arranged within the terminal housing chamber and is interposed between the connector housing and the terminal fitting, the partner terminal, or the compression coil spring.

5. The connector according to claim 1, further comprising:

a biasing member that is housed in the terminal housing chamber and biases the terminal fitting toward the contact.

6. The connector according to claim 5, wherein the biasing member is a diagonally wound coil spring that has a coil shape that is formed by winding a wire a plurality of turns so as to incline in one direction relative to an axis.

7. The connector according to claim 1, wherein the terminal fitting includes a groove that extends along the movement path of the contact.

* * * * *